US012503806B2

(12) United States Patent
Torun et al.

(10) Patent No.: US 12,503,806 B2
(45) Date of Patent: Dec. 23, 2025

(54) DEVICE FOR INSTALLATION ON AN INNER CIRCUMFERENTIAL SURFACE OF A WASHING MACHINE DRUM

(71) Applicant: Henkel AG & Co. KGaA, Duesseldorf (DE)

(72) Inventors: Boray Torun, Duesseldorf (DE); Peter Schmiedel, Duesseldorf (DE); Bent Rogge, Duesseldorf (DE); Guido Grundmeier, Paderborn (DE); Markus Voigt, Paderborn (DE); Christoph Ebbert, Paderborn (DE)

( * ) Notice: Subject to any disclaimer, the term of this patent is extended or adjusted under 35 U.S.C. 154(b) by 686 days.

(21) Appl. No.: 17/696,082

(22) Filed: Mar. 16, 2022

(65) Prior Publication Data

US 2022/0205163 A1 Jun. 30, 2022

Related U.S. Application Data

(63) Continuation of application No. PCT/EP2020/073022, filed on Aug. 17, 2020.

(30) Foreign Application Priority Data

Sep. 16, 2019 (DE) ..... 102019124813.2

(51) Int. Cl.
*D06F 39/02* (2006.01)
*D06F 35/00* (2006.01)

(52) U.S. Cl.
CPC ..... *D06F 39/024* (2013.01); *D06F 35/003* (2013.01)

(58) Field of Classification Search
CPC .... D06F 35/001; D06F 35/003; D06F 39/024; D06F 35/00
See application file for complete search history.

(56) References Cited

U.S. PATENT DOCUMENTS 4,319,973 A * 3/1982 Porta ..... D06F 35/003 8/111
2003/0109398 A1* 6/2003 Yoneda ..... C11D 3/48 510/276

(Continued)

FOREIGN PATENT DOCUMENTS

DE 19934593 A1 1/2001
DE 102014206097 A1 10/2015

(Continued)

*Primary Examiner* — Michael E Barr
*Assistant Examiner* — Kevin G Lee
(74) *Attorney, Agent, or Firm* — Blank Rome LLP

(57) ABSTRACT

A device for installation on an inner circumferential surface of a washing machine drum, comprising a housing, a voltage source and at least one electrode which is connected to the positive terminal of the voltage source and acts as an anode, it being possible for a washing liquor to flow through the device and said device comprising at least one inlet for introducing washing liquor into the device and at least one outlet for discharging washing liquor from the device. The inlet and the outlet are arranged on the device such that, when the device is in use position, said inlet and outlet are directly above the inner circumferential surface of the washing machine drum and the inlet is in a plane of which the surface normal extends. Use of this device and a related method are also disclosed.

20 Claims, 2 Drawing Sheets

(56) References Cited

U.S. PATENT DOCUMENTS

| | | | | |
|---|---|---|---|---|
| 2003/0213503 | A1* | 11/2003 | Price | C11D 3/3953 134/40 |
| 2008/0244835 | A1* | 10/2008 | Lim | D06F 35/003 68/17 R |
| 2016/0369447 | A1* | 12/2016 | Spill | C02F 1/32 |
| 2017/0298305 | A1* | 10/2017 | Haetzelt | D06F 35/003 |

FOREIGN PATENT DOCUMENTS

| | | | |
|---|---|---|---|
| DE | 102014220623 | A1 | 4/2016 |
| EP | 3085828 | A1 | 10/2016 |
| EP | 3134500 | B1 | 3/2017 |
| JP | 2000185191 | A | 7/2000 |

* cited by examiner

DEVICE FOR INSTALLATION ON AN INNER CIRCUMFERENTIAL SURFACE OF A WASHING MACHINE DRUM

FIELD OF THE INVENTION

The invention relates to a device for installation on an inner circumferential surface of a washing machine drum, comprising a housing, a voltage source and at least one electrode which is connected to the positive terminal of the voltage source and acts as an anode, the device being suitable for activating a mediator species into a bleach-active species by way of electrolysis.

BACKGROUND OF THE INVENTION

In the context of the invention, a mediator species is understood to be a substance which is bleach-active in the activated, i.e. oxidized, state. In this state, a mediator species is also referred to as a bleach-active species.

The invention is in the field of washing machine technology, in particular in the field of domestic washing machines. Many everyday stains can only be insufficiently removed from textiles using commercially available washing agents. These include, for example, stains that contain anthocyanin-containing dyes (e.g. from berries) or dyes from the group of carotenoids (e.g. from carrots and tomatoes).

It is generally known that the mentioned stains can be removed through oxidation of the chromophore of the corresponding dyes. By oxidation of the delocalized p-electron system, the dye loses the property of absorbing light in the visual spectral range and thus appears colorless. In addition, in some cases the dye can also break down into smaller and more water-soluble species.

For this purpose, in solid washing agents, bleaching systems are typically used which contain a combination of tetraacetylethylenediamine (TAED) and bleaching agents such as sodium percarbonate or sodium perborate, with TAED acting as an activator for the bleaching agents. This is disadvantageous in that these bleaching systems require comparatively high washing temperatures in order to develop their full effect.

In addition, it is known that customer acceptance for solid washing agents is generally lower than for liquid washing agents. By contrast, liquid washing agents often contain ingredients such as enzymes, dyes and fragrances, which in turn can be attacked and damaged by bleaching agents. This makes it difficult to develop a liquid washing agent with a strong bleaching effect that is suitable for household use.

It is already known in the prior art that an electrochemically mediated bleaching reaction can avoid both the problem of high washing temperatures in solid washing agents and that of incompatibility of the bleaching agent with enzymes and other ingredients in liquid products. The principle of this bleaching process can be seen in the transfer of an oxidation reaction on an anode surface of an electrochemical cell to the textile to be bleached. Presumably, a mediator molecule initially present in reduced form is oxidized at the anode of the electrochemical cell. This oxidized, and therefore activated, mediator species can in turn oxidize a dye molecule, is thus bleach-active, and is itself returned to the reduced species so that it is available for renewed oxidation (activation). In this way, it is possible to achieve a bleaching effect with a comparatively small amount of mediator, since, in contrast to a traditional system, it is not necessary to select a stoichiometric use amount for the substrate to be bleached. In addition, the mediator molecule is only able to oxidize substrates in conjunction with an electrochemical cell. For this reason, no unwanted reaction to oxidation-sensitive components contained in the washing agent, such as the enzymes, is to be expected. In addition, unlike in a traditional bleaching system, for example based on TAED and sodium percarbonate, there is no need to increase the washing temperature to allow the electrochemical process to take place.

EP 31 34 500 B1 discloses the use of particular organic mediator compounds to enhance the cleaning performance of washing and cleaning agents against stains, washing or cleaning processes using bleach-active species produced from such mediator compounds, and washing and cleaning agents which contain the mediator compound.

BRIEF SUMMARY OF THE INVENTION

It is the object of the present invention to provide a device which is suitable for activating a mediator species into a bleach-active species by way of electrolysis and which can be used in commercially available washing machines. In particular, it is also an object of the invention to design the device in such a way that the electrolysis process is as efficient as possible, and the amount of washing agent and mediator species used can be kept as low as possible. Related methods and uses of the disclosed are also described herein.

The device according to the invention comprises a housing, a voltage source and at least one electrode which is connected to the positive terminal of the voltage source and acts as an anode, it being possible for a washing liquor to flow through the device and said device comprising at least one inlet for introducing washing liquor into the device and at least one outlet for discharging washing liquor from the device. The device is characterized in that the at least one inlet and the at least one outlet are arranged on the device in such a way that, when the device is in its use position, said inlet and outlet are directly above the inner circumferential surface of the washing machine drum and the at least one inlet is in a plane of which the surface normal extends, when the device is in its use position, substantially orthogonally to the axis of rotation of the washing machine drum, and in that the at least one electrode is arranged within the device in such a way that its longitudinal extent extends substantially in parallel with the surface normal of the plane in which the at least one inlet is located.

In other words, the invention relates to a device which is intended and suitable for being installed on an inner circumferential surface of a washing machine drum. In particular, said device can be retrofitted into existing washing machines. A common domestic washing machine can thus be retrofitted with the device according to the invention in a simple manner without further modifications or adaptations.

In the context of the invention, the inner circumferential surface of a washing machine drum is understood to be the circumferential surface of a washing machine drum that faces the laundry to be washed.

The at least one electrode generally has a length dimension, a width dimension and a height dimension. The longitudinal extension of the at least one electrode is understood to be the longest of these three dimensions.

The device according to the invention comprises its own voltage source and at least one electrode which is connected to the positive terminal of the voltage source and acts as an anode. When a washing liquor containing a mediator species flows through the device, the mediator molecules are oxidized on the surface of this anode. The mediator molecules which have been oxidized in this way, and are thus activated, are bleach-active and can now in turn oxidize a dye molecule. In doing so, they themselves are returned to the reduced species so that they are available for renewed oxidation on the anode surface.

The device according to the invention is characterized in that, due to its special structural design, when in its use position, it is able to scoop up a particularly large amount of washing liquor while the washing machine is in operation, which makes particularly efficient convection of the mediator species to the anode surface possible. In this way, sufficient activation and thus a sufficient bleaching effect can be ensured even with small amounts of mediator species.

The high efficiency is achieved in the device according to the invention in that the at least one inlet and the at least one outlet are arranged on the device in such a way that, when the device is in its use position, said inlet and outlet are directly above the inner circumferential surface of the washing machine drum and the at least one inlet for introducing washing liquor into the device is in a plane of which the surface normal extends, when the device is in its use position, substantially orthogonally to the axis of rotation of the washing machine drum, the at least one electrode being arranged within the device in such a way that its longitudinal extent extends substantially in parallel with the surface normal of the plane in which the at least one inlet is located. In other words, the opening of the at least one inlet of the device or the surface normal of the surface in which the inlet opening is located always points in the direction of rotation when the washing machine drum is rotating. In this way, particularly when passing through the sump which collects washing liquor in the lower region of the washing machine drum while the washing machine is in operation, the device installed on the inner circumferential surface of the washing machine drum can scoop up a comparatively large amount of washing liquor from the sump, and this scooped-up washing liquor is then immediately guided along the anode which extends as an extension of the inlet.

Since the direction of rotation of a washing machine drum usually changes several times while a washing machine is in operation, according to one embodiment of the invention, the at least one outlet is also in a plane of which the surface normal extends, when the device is in its use position, substantially orthogonally to the axis of rotation of the washing machine drum. A device designed in this way makes it possible to ensure sufficient convection of the activated mediator to the textile to be cleaned and of the deactivated mediator to the anode of the device, regardless of the direction of rotation of the washing machine drum.

According to one proposal of the invention, the housing surrounds a first receiving space and a second receiving space, the at least one electrode being received in the first receiving space and the voltage source being received in the second receiving space, and it being possible for washing liquor to flow through the first receiving space and said first receiving space being separated from the second receiving space in a liquid-tight manner.

The housing is preferably designed as a dimensionally stable housing made of a non-electrically conductive material. Advantageous materials are, for example, plastics materials having a low specific weight and high strength and impact resistance.

A suitable material selection and suitable dimensions make it possible to limit the total mass of the device according to the invention to a maximum of approximately 1 kg. In this way, an imbalance can be substantially prevented from forming in spin phases. For this purpose, it is also conceivable to install two devices according to the invention that have a similar weight and synergistic function on mutually opposite regions of the inner circumferential surface of the washing machine drum. This measure can further minimize imbalances.

The side of the housing that faces the inner circumferential surface of the washing machine drum when the device is in its use position can be convex in order to optimally fit into the curvature of the washing machine drum. In addition, the housing can be largely smooth and edge-free, in order to minimize damage to the laundry items caused by excessive mechanical stress during operation.

According to one embodiment of the invention, the device comprises two or more electrodes, each electrode being connected to a terminal of the voltage source. In this way, at least one electrode of the device is always connected to the positive terminal of the voltage source and accordingly acts as an anode. In addition, further electrodes can be connected either as anodes or as cathodes. In principle, every electrode of the device can be connected as an anode or as a cathode. The ratios (number of anodes)/(number of cathodes) and/or (anode surface area)/(cathode surface area) can be freely selected, in principle, and can be changed during the electrolysis process.

Fundamentally, electrodes connected as cathodes have to be present, in order to provide for a sufficient counterreaction to the electrochemical activation reaction at the anode. One or more electrodes of the device can be connected as cathodes. According to one proposal of the invention, however, it is also possible for all electrodes of the device to be connected as anodes and for the washing machine drum to be connected as a cathode by being in appropriate electrical contact with the device according to the invention. In this way, it is possible to maximize the anode surface required for the activation of the mediator, since the device according to the invention does not itself have to provide its own cathode surface. In addition, it has been shown that connecting the washing machine drum as a cathode has a positive effect on corrosion resistance and the stability of the material of the washing machine drum.

If the washing machine drum is connected as a cathode, the device according to the invention preferably comprises a mechanism for establishing electrical contact with the washing machine drum.

The electrodes connected as anodes can have various shapes and/or surface properties. For example, the anodes can be planar shapes such as sheets, or shaped bodies based on machining or non-machining shaping. The surface of the anodes can be designed as a thin layer that is applied to a substrate, for example by evaporation or plasma deposition. Alternatively, the surface of the anodes can be a woolly structure, spongy structure and/or a surface of a textile nature, for example a woven or non-woven knitted fabric. In any case, it is essential that there is electrical conductivity within the material sufficient for the electrolysis process and a sufficient surface area for intensive exchange with the washing liquor. Known methods for surface treatment, such as roughening, grinding, etching and/or pickling, can be used to enlarge the anode surface.

If an electrode of the device is used as a cathode, it can be formed in a material that is identical to or different from that of the anode or anodes. The size and/or the volume and/or the surface area and/or the mass of the cathode can be identical to or different from that in the design of the anodes.

In order to maximize the anode surface available for the activation reaction, according to a further proposal of the invention, the at least one electrode can be in the form of a tube through which washing liquor can flow. Such a tubular design of the electrodes provides reaction surfaces both on the inside and on the outside of the tube, and so the activation of the mediator species can take place very efficiently. The tubes can have a circular, elliptical or polygonal cross section, and, if there are multiple tubes, all tubes can have the same cross-sectional shape or different cross-sectional shapes. The tubes can be made from a metal material.

The tubes are arranged inside the device in such a way that, when the device is in its use position, the longest axis of the tubes is oriented in each case substantially orthogonally to the axis of rotation of the washing machine drum. In this way, it is possible to efficiently guide the amount of washing liquor scooped up by the device while the washing machine drum is rotating past the anode surface and thus bring about sufficient activation of the mediator species.

In a further embodiment of the invention, the diameter of the tubes can vary over the length of said tubes. In particular, the diameter of the tubes can be widened in the manner of a funnel at the end of said tubes that faces the inlet and/or the outlet of the device. This effectively supports efficient scooping up of the washing liquor into the interior of the tubes.

In the context of the invention, it is also possible for a tubular electrode to comprise two half-tubes which are connected in an electrically non-conductive manner so as to form the tubular electrode. One half-tube can be connected as an anode and the other half-tube, which is electrically separated from the first half-tube, can be connected as a cathode. In this way, the ion resistance can presumably be minimized.

In a further embodiment of the inventive concept, a tubular electrode can be divided, in the direction of its longitudinal axis, into at least two tubular segments which are each separated from one another by a non-conductive material layer, and which can be connected differently. In conjunction with an acceleration sensor and a suitable control unit, this ensures that the washing liquor always flows through an anode first and only then through a cathode, regardless of the direction of rotation of the washing machine drum and thus regardless of the flow direction of the washing liquor through the tubular electrodes. In this way, it is possible to maximize the concentration of bleach-active, activated mediator species in the washing liquor.

According to another embodiment of the invention, the at least one electrode in the form of a tube comprises an inner cavity or protuberance which is filled with washing liquor during the scooping-up process in which the device scoops up washing liquor from the sump, and is only emptied again at a later point in the rotation when the device has moved well out of the sump again. In this way, the average holding time of the scooped-up washing liquor containing the mediator species on the electrode surface of the device can be extended. This increases the efficiency of the electrochemical process, since the specific yield of activated mediator per rotation is maximized.

In one variant, the device according to the invention comprises at least one sensor for recording at least one variable selected from conductivity, temperature, state of motion, acceleration and sound. In this case, the device preferably also comprises an electronic control system and/or a control unit to which the signals from the at least one sensor are supplied and which controls and/or regulates the voltage source according to the signals from the sensors. Using such sensors, it is possible to detect the beginning and/or the end of a wash cycle and/or other characteristic states during a wash cycle, such as a heating phase, a certain rinse cycle, the addition of washing agent, the direction of rotation of the washing machine drum, etc. In response to the signals from the sensors, the device according to the invention can be controlled and/or regulated, for example activated and deactivated, by means of the control unit and/or the electronic control system.

In addition, the device can comprise at least one interface for optical communication and/or acoustic communication and/or radio communication. Operating parameters of the device can be read out and, where necessary, influenced via these interfaces. Optical communication can take place, for example, via infrared, and acoustic communication can take place, for example, via sound waves. Common radio protocols such as WiFi, Bluetooth, ZigBee or Z-Wave can be used for radio communication.

The voltage source of the device is used to apply the potential required for the electrochemical reaction to the electrodes. The amount of the potential difference between the electrodes is between 0 V and 5 V, preferably between 0.5 V and 4.5 V, particularly preferably between 1.5 V and 3.5 V. The polarization can be freely selected. The voltage source is designed such that it can provide the current strength required for the selected potential. According to one embodiment of the invention, the voltage source is in the form of a battery or a rechargeable secondary battery. In the case of a secondary battery, this can be removed from the device and can be charged, for example, in a separate external device; however, the device can also be connected directly to an external charging device. In principle, charging can take place via a cable or by means of an inductive process. Alternative known charging mechanisms are also possible.

In a further embodiment of the invention, the device comprises a generator. According to the "energy harvesting" principle, such a generator can convert some of the kinetic energy from the movement of the device together with the washing machine drum into electrical energy and thus directly operate the device or charge an energy store. For example, the generator can, by means of a pendulum, a flywheel or a turbine, absorb or pick up the energy.

Since the device according to the invention comprises its own voltage source, it is intrinsically functional and thus compatible with a large number of commercially available washing machines without certain structural modifications or adaptations having to be made to these washing machines.

As already stated, the device can comprise an electronic control system by means of which the voltage can be regulated. The voltage can be regulated according to sensor signals, it can also be regulated according to parameters which are stored in a memory unit or are received via communication interfaces. By regulating the voltage, inter alia, the activity of the bleaching process can be controlled, for example depending on the degree of soiling of the laundry to be cleaned. It is also possible to adjust which electrodes are connected as anodes or as cathodes at which point in time.

The surrounding area of the voltage source within the housing can be padded with suitable flexible materials in order to protect the voltage source from vibrations and/or impacts.

According to one embodiment of the device according to the invention, fastening means are provided, by means of which the housing of the device can be detachably fastened on an inner circumferential surface of a washing machine drum. The fastening can be achieved, for example, by joining with glue, using magnets or using a mechanical tensioning mechanism. An auxiliary element can also be provided, which is first fastened on the inner circumferential surface of the washing machine drum and on which the housing of the device according to the invention is then fastened. In principle, every form of fastening can be reversible or irreversible, i.e. the device can be fastened on the inner circumferential surface of the washing machine drum permanently or only for a limited period of use. Due to the fastening mechanisms mentioned by way of example, the device according to the invention is compatible with a large number of commercially available washing machines and can easily be retrofitted into these washing machines.

The invention also includes the use of a device disclosed herein on an inner peripheral surface of the washing machine drum of a washing machine for activating a mediator species during a washing process. Finally, the invention also relates to a method for activating a mediator species while a washing machine is in operation is further disclosed. The method includes installing a device as described herein on an inner circumferential surface of a washing machine drum of the washing machine in such a way that the at least one inlet of the device is in a plane of which the surface normal extends substantially orthogonally to the axis of rotation of the washing machine drum, providing the mediator species in the washing liquor, and operating the device and the washing machine.

Due to particularly simple installation and applicability, the device according to the invention, its use and the method provided according to the invention make it possible for a consumer to use the new bleaching process using a mediator species in commercially available washing machines in a particularly efficient manner.

BRIEF DESCRIPTION OF THE DRAWINGS

The invention is explained in greater detail in the following with reference to the accompanying drawings, in which.

DETAILED DESCRIPTION OF THE INVENTION

Figure 1:
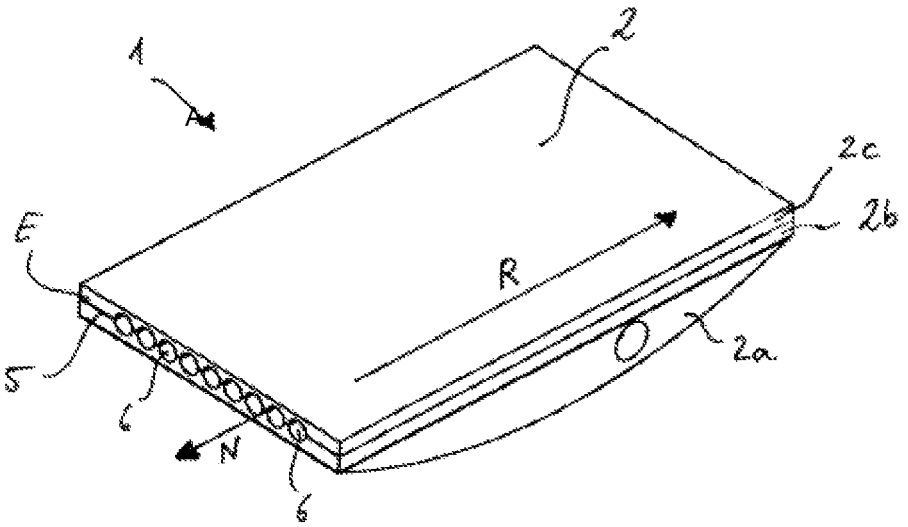
FIG. 1 is a schematic view of an embodiment of the device according to the invention.
Figure 2:
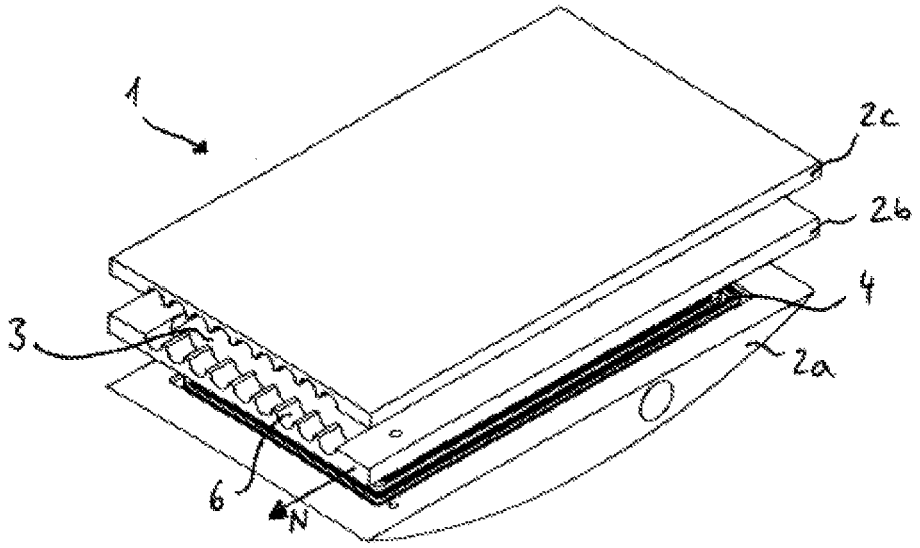
FIG. 2 is a schematic exploded view of the device from FIG. 1.

FIGS. 1 and 2 are schematic views of a device according to the invention, denoted as a whole by reference sign 1. The device 1 comprises a housing 2 made of a plastics material, which in turn comprises three housing components 2*a*, 2*b* and 2*c*. The housing component 2*b* is arranged between the housing components 2*a* and 2*c*.

The device 1 comprises, in the region of an end face 5, nine inlets 6 for introducing washing liquor into the device 1. The inlets 6 are in a common plane E formed by the end face 5. In the embodiment of the device 1 according to FIGS. 1 and 2, the end face 5 is formed by the housing components 2*b* and 2*c*. On a side which is opposite the end face 5 and is the remote side in the views of FIGS. 1 and 2, the device 1 comprises nine outlets (not visible) for discharging washing liquor from the device 1, with each inlet 6 being arranged in alignment with one outlet.

The housing 2 surrounds a first receiving space 3 and a second receiving space 4, the first receiving space 3 and the second receiving space 4 being separated from one another in a liquid-tight manner. The first receiving space 3 is delimited by the housing components 2*b* and 2*c*, while the second receiving space 4 is delimited by the housing components 2*a* and 2*b* The housing component 2*b* is thus used as a liquid-tight partition between the two receiving spaces 3 and 4.

A plurality of electrodes is received in the first receiving space 3, which electrodes are not shown in the drawings for the sake of clarity. The electrodes are designed as tubes of a circular cross section, through which washing liquor can flow and the longitudinal extent of which extends substantially in parallel with the surface normal N of the plane E in which the inlets 6 are located. The surface normal N is orthogonal to the plane E. The electrodes, which are in the form of tubes, thus extend within the first receiving space 3 substantially in a direction indicated by the arrow R. During operation of the device 1, washing liquor can flow into the first receiving space 3 through the inlets 6. Within the receiving space 3, the washing liquor flows along the electrodes at which an electrochemical activation reaction, which is described in greater detail below, takes place. The activated washing liquor is then guided out of the device 1 again from the outlets and is available for the rest of the washing process. Due to the liquid-tight separation between the first receiving space 3 and the second receiving space 4 by the housing component 2*b*, no washing liquor can enter the second receiving space 4.

A voltage source, which is also not shown for reasons of clarity, is arranged in the second receiving space 4. Here, the voltage source is in the form of a secondary battery having a positive terminal and a negative terminal. The electrodes in the first receiving space 3 are connected to the negative or the positive terminal of the voltage source by means of corresponding line connections, with substantially the same number of electrodes being connected to the positive terminal as to the negative terminal of the voltage source. The line connections are guided through the housing component 2*b*, said connections being guided therethrough such that no liquid can get from the first receiving space 3 into the second receiving space 4. The electrodes connected to the positive terminal of the voltage source act as anodes, while the electrodes connected to the negative terminal of the voltage source act as cathodes.

In addition to the voltage source, an electronic control system (also not shown) is also received in the second receiving space 4, by means of which system the voltage supplied by the voltage source can be regulated.

Figure 3:
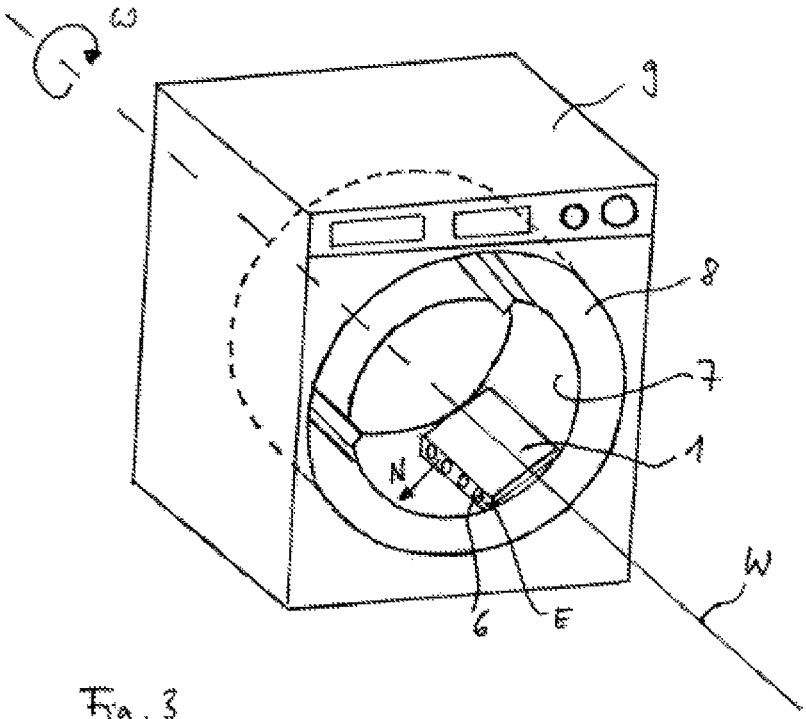
FIG. 3 is a schematic view of a device according to the invention in its use position, installed on an inner circumferential surface of a washing machine drum.

FIG. 3 is a purely schematic view of a device 1 in its use position, installed on an inner circumferential surface 7 of a washing machine drum 8 of a washing machine 9. As can also be seen from FIGS. 1 and 2, the device 1 is convex on its outside in the region of the housing component 2*a* so that it can be inserted into the curvature of a washing machine drum 8 by said housing component 2*a*. The inlets 6 and also the outlets of the device 1 are arranged in such a way that, when the device 1 is in its use position, said inlets and outlets are directly above the inner circumferential surface 7 of the washing machine drum 8. Furthermore, the inlets 6 are in a plane E of which the surface normal N extends, when the device 1 is in its use position, substantially orthogonally to the axis of rotation W of the washing machine drum 8, as can be seen from FIG. 3. The device 1 is fastened in a fixed, but detachable, manner on the inner circumferential surface 7 of the washing machine drum 8 by means of a mechanical tensioning mechanism and thus moves together with the washing machine drum 8 while the washing machine 9 is in operation.

As a result of the special structural design of the device 1, i.e. in particular as a result of the inlets 6 located directly above the inner circumferential surface 7 and their arrangement in a plane E of which the surface normal N extends, when the device 1 is in its use position, substantially orthogonally to the axis of rotation W of the washing machine drum 8, and as a result of the electrodes of which the longitudinal extent extends substantially in parallel with the surface normal N, particularly when passing through the sump which collects washing liquor in the lower region of the washing machine drum 8 while the washing machine 9 is in operation, the device 1 installed on the inner circumferential surface 7 of the washing machine drum 8 can scoop up a comparatively large amount of washing liquor from the sump, and this scooped-up washing liquor is then immediately guided along the anodes which extend as an extension of the inlets 6.

If the washing machine 9 is operated using a washing liquor containing a mediator species, with a direction of rotation w assumed in FIG. 3, the device 1 scoops up a certain amount of washing liquor, particularly when passing through the sump which collects washing liquor in the lower region of the washing machine drum 8. The washing liquor passes through the inlets 6 into the first receiving space 3 of the device 1 and flows along the anodes which extend as an extension of the inlets 6. The mediator molecules initially present in reduced form in the washing liquor are oxidized at the anodes of the device 1. The washing liquor enriched in this way with oxidized mediator molecules exits again from the outlets of the device 1. The oxidized mediator molecules can in turn oxidize dye molecules in the washing liquor or on textiles, are therefore bleach-active, and are themselves returned to the reduced species so that they are available again for renewed oxidation.

The design according to the invention of the device 1, which, when in its use position, uses the rotation of the washing machine drum (8) to scoop up washing liquor, thus provides for particularly efficient convection of the mediator species to the anode surfaces. In this way, sufficient activation of the mediator species and thus a corresponding bleaching effect can be ensured even with small amounts of mediator species.

What is claimed is:

1. A device configured to be installed on an inner circumferential surface of a washing machine drum, the device comprising:

a housing extending from a first end face to a second end face along a longitudinal direction, the housing defining a first receiving space and a second receiving space;

a voltage source received in the second receiving space;

at least one electrode received in the first receiving space and that extends from the first end face to the second end face, the at least one electrode being connected to a positive terminal of the voltage source;

at least one inlet defined in the first end face and configured to receive a washing liquor into the device, the at least one inlet being in fluid communication with the at least one electrode in the first receiving space; and at least one outlet defined in the second end face and configured to discharge the washing liquor from the device, the at least one outlet being in fluid communication with the at least one electrode in the first receiving space, wherein an outer surface of the housing that at least partially defines the second receiving surface is convex such that, when the device is installed on the inner circumferential surface of the washing machine drum, the at least one inlet and the at least one outlet are directly above the inner circumferential surface of the washing machine drum.

2. The device of claim 1, wherein the first receiving space is separated from the second receiving space in a liquid-tight manner such that no washing liquor enters the second receiving space.

3. The device of claim 1, wherein the at least one electrode comprises two or more electrodes that are each connected to the positive terminal of the voltage source.

4. The device of claim 1, wherein the at least one electrode is in the form of a hollow tube defining a lumen in fluid communication with the at least one inlet and the at least one outlet, wherein the washing liquor is configured to flow into the at least one inlet, through the lumen, and out of the at least one outlet.

5. The device of claim 4, wherein the hollow tube has a circular, elliptical, or polygonal cross section.

6. The device of claim 4, wherein a diameter of the hollow tube varies over the length of the hollow tube from the first end face to the second end face.

7. The device of claim 6, wherein the diameter of the hollow tube is greater at the at least one inlet and/or the at least one outlet than in between the at least one inlet and the at least one outlet.

8. The device of claim 1, wherein the device further comprises at least one sensor configured to measure at least one of conductivity, temperature, motion, acceleration, or sound.

9. The device of claim 8, wherein the device further comprises a controller configured to receive measurements from the at least one sensor and to control the voltage source based on the measurements.

10. The device of claim 1, wherein the voltage source is a battery.

11. The device of claim 1, further comprising a generator.

12. The device of claim 11, wherein the generator is a pendulum, a flywheel, or a turbine configured to generate energy.

13. The device of claim 1, further comprising at least one interface for optical, acoustic, and/or radio communication.

14. The device of claim 1, further comprising a fastener configured to detachably fasten the housing to the inner circumferential surface of the washing machine drum.

15. A method for activating a mediator species while a washing machine is in operation, the method comprising:

installing the device of claim 1 on the inner circumferential surface of the washing machine drum of the washing machine such that the at least one inlet and the at least one outlet are directly above the inner circumferential surface of the washing machine drum;

providing the mediator species in the washing liquor; and operating the device and the washing machine.

16. The device of claim 1, wherein, when the device is installed on the inner circumferential surface of the washing machine drum, the at least one inlet and the at least one outlet are substantially orthogonal to the axis of rotation of the washing machine drum.

17. The device of claim 1, wherein the at least one electrode acts as an anode.

18. The device of claim 1, wherein an outer surface of the housing that at least partially defines the first receiving space is flat, and the at least one electrode extends from the first end face to the second end face of the housing in a plane parallel to the flat outer surface of the housing that at least partially defines the first receiving space.

19. A device configured to be installed on an inner circumferential surface of a washing machine drum, the device comprising:

a housing extending from a first end face to a second end face along a longitudinal direction;

at least one inlet defined in the first end face;

at least one outlet defined in the second end face;

at least one hollow tube defining a first lumen in fluid communication with the at least one inlet and the at least one outlet such that washing liquor in configured to flow through the first lumen;

a voltage source received in the housing, a positive terminal of the voltage source being electrically connected to the at least one hollow tube; and a fastener configured to detachably fasten the housing to the inner circumferential surface of the washing machine drum, wherein, when the device is installed on the inner circumferential surface of the washing machine drum, the at least one inlet and the at least one outlet are substantially orthogonal to the axis of rotation of the washing machine drum.

20. The device of claim 19, wherein, when the device is installed on the inner circumferential surface of the washing machine drum, the at least one inlet and the at least one outlet are directly above the inner circumferential surface of the washing machine drum.

* * * * *